US007478991B2

(12) United States Patent
Noelle

(10) Patent No.: US 7,478,991 B2
(45) Date of Patent: Jan. 20, 2009

(54) VARIABLE NOZZLE DEVICE

(75) Inventor: Phillipe Noelle, Vincey (FR)

(73) Assignee: Honeywell International, Inc., Morristown, NJ (US)

( * ) Notice: Subject to any disclaimer, the term of this patent is extended or adjusted under 35 U.S.C. 154(b) by 82 days.

(21) Appl. No.: 11/368,853

(22) Filed: Mar. 6, 2006

(65) Prior Publication Data

US 2007/0207030 A1 Sep. 6, 2007

(51) Int. Cl.
*F04D 29/56* (2006.01)

(52) U.S. Cl. ..... 415/159; 415/160; 415/163; 415/164; 415/165

(58) Field of Classification Search ..... 415/159, 415/160, 163, 164, 165
See application file for complete search history.

(56) References Cited

U.S. PATENT DOCUMENTS 3,243,159 A 3/1966 Hefler et al.
4,130,989 A 12/1978 Wirth et al.
7,044,708 B2 * 5/2006 Hausknecht ..... 415/1
2004/0240989 A1 * 12/2004 Willshee et al. ..... 415/148
2005/0226718 A1 10/2005 Marcis et al.

FOREIGN PATENT DOCUMENTS

EP 1422400 5/2004
GB 731822 3/1953
WO 2005057018 6/2005

OTHER PUBLICATIONS

PCT ISR/WO PCT/US07/063173.

* cited by examiner

*Primary Examiner*—Igor Kershteyn
(74) *Attorney, Agent, or Firm*—Lee & Hayes LLP.

(57) ABSTRACT

A variable nozzle device comprises a wall member, a unison ring provided on a first side of the wall member, and a vane, a vane body of which is provided on a second side of the wall member, said second side being opposite to said first side, wherein said vane further having a tab member comprising a tab portion and a shaft portion, said shaft portion being movably inserted in a slot of the wall member; and said tab portion being adapted to hold the vane body by abutting against a portion of the wall member which defines the slot, wherein the vane body and the tab member are provided as separate, parts and are fixable to each other.

16 Claims, 7 Drawing Sheets

VARIABLE NOZZLE DEVICE

FIELD OF THE INVENTION

The invention relates to a variable nozzle device having at least a vane mounted thereto, and a method of assembling the vane to the wall member of the variable nozzle device.

BACKGROUND

Variable geometry nozzle systems with adjustable pivot vane configurations require the vanes to be positioned in a nozzle of a compressor, for example. For this purpose, a preassembled variable nozzle cartridge already comprising vanes can be mounted to the compressor of a turbocharger.

One possibility of such a variable nozzle cartridge comprises among other parts two parallel wall members, i.e. a disk insert or diffuser plate and a back plate, between which vanes are disposed. Each vane is pivotally mounted to the back plate by means of a pivot axle of the vane about which the vane can pivot, and by means of a tab member having an elongated head and being integrally provided on the vane. When mounting the vane to the back plate, the pivot axle is stuck into a respective hole of the back plate and the tab member is inserted into a respective assembly slot of the back plate as well as into an actuating slot of a unison ring positioned on the backside of the back plate. The back plate also has guide slots each of which is substantially perpendicular to the associated assembly slot and is in connection therewith such that one guide slot and one assembly slot established a T-shaped slot in the back plate. The guide slots guide shafts of the tab members when the unison ring is rotated relative to the back plate so as to pivot the vanes.

Furthermore, spacers are provided between the back plate and the diffuser plate so as to secure a certain distance there between. The diffuser plate provides a sliding surface for the vanes.

There exists a need for a variable nozzle device having a high performance and a high functionality.

SUMMARY OF THE INVENTION

According to a first aspect, the above need is met with a variable nozzle device comprising a wall member, a unison ring, and a plurality of vanes, wherein each vane has a vane body and a tab member comprising a tab portion and a shaft portion, said shaft portion passing through a slot of the wall member, and said tab portion overlapping the slot to hold the vane, wherein the vane body and the tab member are provided as separate parts and are fixable to each other. Since the vane is provided from separate parts which are fixable to each other, the vane can be mounted to the wall member by arranging the vane body on the first side of the wall member and by inserting the tab member from the second side thereof. Consequently, the tab portion does not need to be inserted through the slot of the wall member from the first side. As a result, the slot does not need to have a shape or a portion through which the tab portion can be passed. The slots only need to be shaped for guiding purposes of the shaft portion of the vane. Prom the view of the guiding purpose, the slot is preferably curvilinear.

Furthermore, since the slot does not need to have a portion through which the tab portion can be passed for mounting, there is no fear that, after mounting, the vane falls out of the slot. Accordingly, there exists no position of the vane in which the vane is not held by the abutting action of the tab portion to the wall member. As a result, the entire extent of the slot can be used for guiding the vane. For the same reason, no diffuser plate, which would support the vane, needs to be provided as a part of the variable nozzle device.

Preferably, the unison ring is provided on a first side of the wall member and the vane body is provided on a second side of the wall member, which sides. are opposite to each other. Further preferably, the tab portion holds the vane by the tab member abutting against a portion of the wall member which defines the slot.

Preferably, a mounting hole is provided in the vane body at a side of the vane body which faces the wall member when the vane body is mounted to the wall member, and a tip section of the shaft portion is insertable into the mounting hole of the vane body.

The tab member can be fixable to the vane body by press-fitting the tip section of the shaft portion into the mounting hole. This allows a simple and effective mounting procedure of the vane to the wall member.

Furthermore, the tip section and the mounting hole may have corresponding cross-sectional shapes which fit to each other and which provide a relative rotation preventing means for preventing a rotation of the tab member relative to the vane body. This allows an improved mounting performance when mounting the vane to a variable nozzle device having unison ring comprising an actuating slot in which the tab portion is to be located and wherein the tab portion requires a specified orientation with respect to the actuating slot. Especially, the relative rotation preventing means provides a predetermined orientation of the vane body with respect to the rotational position of the unison ring.

The shaft portion may comprise a spacing section disposed between the tip section and the tab portion, wherein said spacing section defines a predetermined distance between the tip section and the tab portion. The cross-sectional area of the spacing section can be larger than the cross-sectional area of the tip section to form a stop face which restricts the insertion depth of the tab member. Thus, when mounting the vane to the wall member, the tip portion of the tab member can be press-fitted into the mounting hole of the vane body until the stop face abuts against the vane body. As a result, the above explained distance between the vane body and the tab portion can easily be secured in the mounting process of the vane. Said distance is preferably set such that the vane body is prevented from floating away from the wall member.

The wall member may comprise a slotted portion having the slot through which the shaft portion of the tab member is to be passed for mounting the vane to the wall member, and the length of the spacing section is set based on a thickness of the slotted portion such that the tab portion and the vane body slidingly grip the wall member there between when the vane assembly is mounted to the wall member. As a result, the vane body can be prevented from floating from the vane side surface of the insert. Consequently, the variable nozzle device is not required to have a diffuser plate for supporting the vane body in the axial direction of the wall member which is the direction perpendicular to the surface on which the vane body is mounted. As a result; spacers for securing a distance between the wall member and the diffuser plate can be omitted. Since the conventionally known spacers and diffuser plate have resulted in adverse aerodynamic effects, the aerodynamic performance of a variable nozzle device having the vane according the invention is improved.

Preferably, the slot acts as a guide slot for guiding the shaft portion of the tab member.

The vane body may also comprise a pivot axle about which the vane body can pivot when being mounted to the wall member. The pivot axle is preferably provided on the same side of the vane body on which the mounting hole for mounting the tab member is provided. This allows for mounting the vane to only one wall member without a second wall member necessary on the side of the vane body opposite to the side on which the tab member is to be mounted.

According to a second aspect of the invention, the above need is met with a method of assembling a variable nozzle device having the above features. The method includes the steps of arranging the vane body on one side of the wall member, passing the shaft portion of the tab member through the slot from the other side of the wall member, and fixing the shaft portion to the vane body. According to this method, an assembly slot for passing through the elongated tab portion of the tab member from the one side must not be provided in the wall member. Since a conventionally known assembly slot adversely affects the aerodynamic performance of a variable nozzle device, the method according to the invention leads to a variable nozzle device having an improved aerodynamic performance.

Preferably, the shaft portion is fixed to the vane body by inserting the tip section of the shaft portion into the mounting hole of the vane body.

Furthermore, the mounting hole of the vane body can be aligned with the slot of the wall member before passing the shaft portion of the tab member through the slot, and fixing of the shaft portion to the vane body can be made by press-fitting the tip section into the mounting hole.

Preferably, before performing the step of inserting the shaft portion of the tab member through the slot of the wall member into the mounting hole, the following steps are performed: arranging the unison ring having an actuating slot on said second side of the wall member, aligning the actuating slot with the slot of the wall member, and then inserting the shaft portion through said actuating slot of the unison ring to place the tab portion in said actuating slot.

The method may further comprise the step of pressing the tip portion of the tab member into the mounting hole of the vane body until the stop face of the tab member abuts against the vane body.

BRIEF DESCRIPTION OF THE DRAWINGS

Further features and advantages of the invention will become apparent from the description that follows with reference being made to the enclosed drawings, in which.

DETAILED DESCRIPTION OF THE INVENTION

Figure 1:
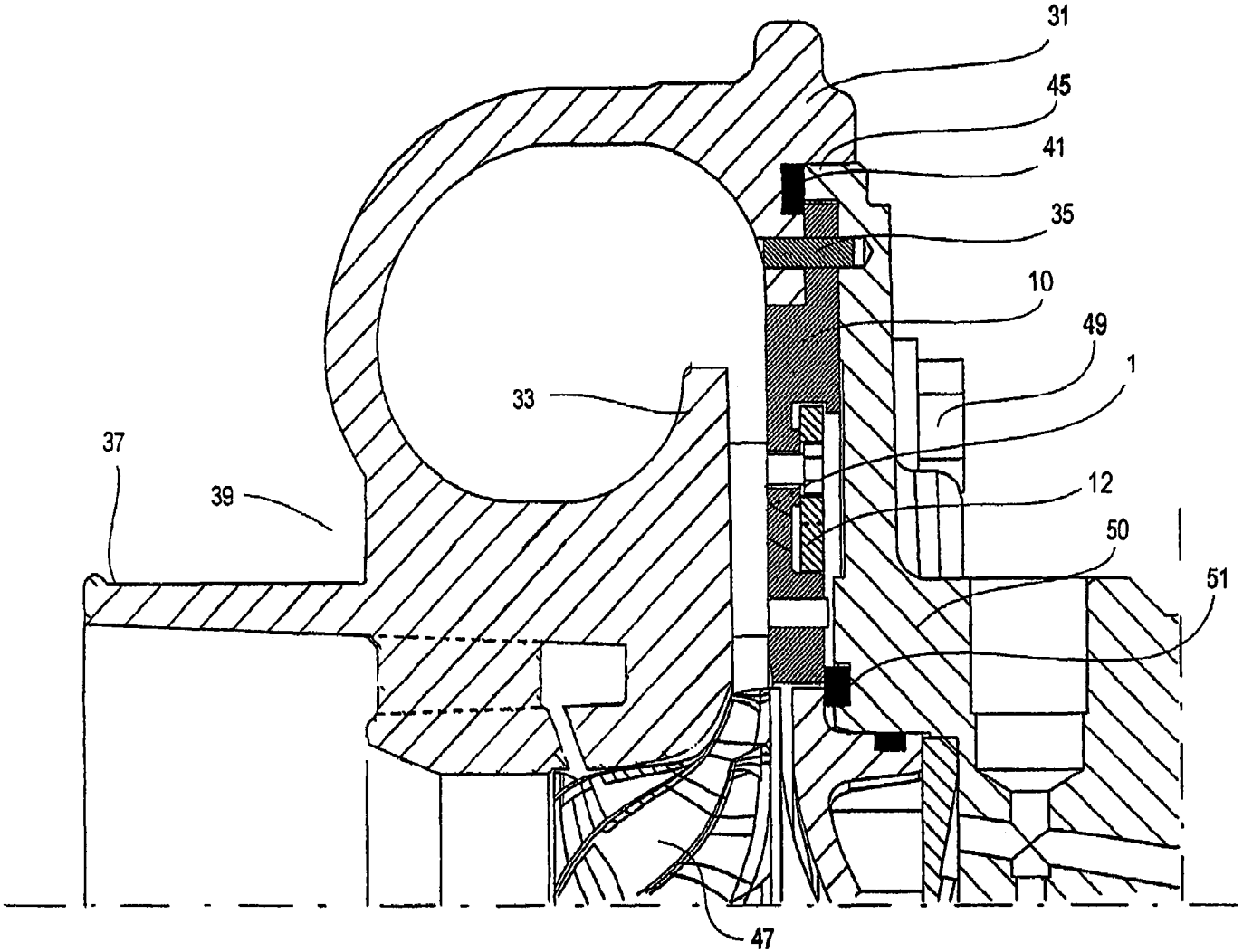
FIG. 1 is cross-sectional view of a compressor housing and a center housing between which a variable nozzle device having pivotable vanes according to an embodiment of the invention is mounted.

FIG. 1 shows a cross-sectional view of a portion of a compressor housing and a center housing of a turbocharger having a variable nozzle device according to an embodiment of the invention. Air is compressed by a compressor wheel 47 through a nozzle into a volute. The nozzle is formed between a nozzle portion 33 of the compressor housing and a wall member 10 which in the following is referred to as an insert.

Pivotable vanes 1 are provided in the nozzle and the cross sectional area of the nozzle can be adjusted by pivoting the vanes 1. A unison ring 12 is provided on the side of the insert 10 opposite to the vanes 1 and the vanes 1 can be actuated by a later described actuating mechanism according to which the unison ring 12 is rotated relatively to the insert 10.

Figure 2D:
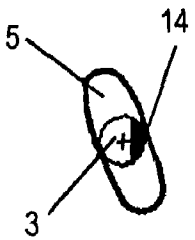
FIG. 2D is a top view of a tab member according to the embodiment of the invention.
Figure 2C:
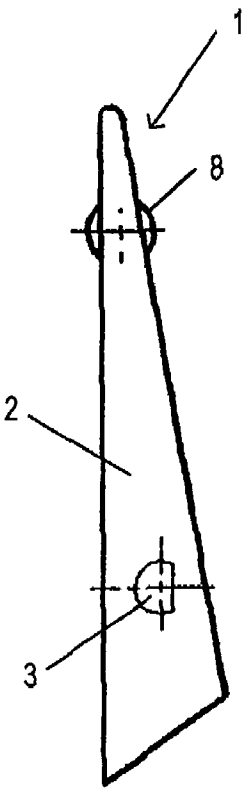
FIGS. 2A to 2C are views of a vane according to the embodiment of the invention.
Figure 2B:
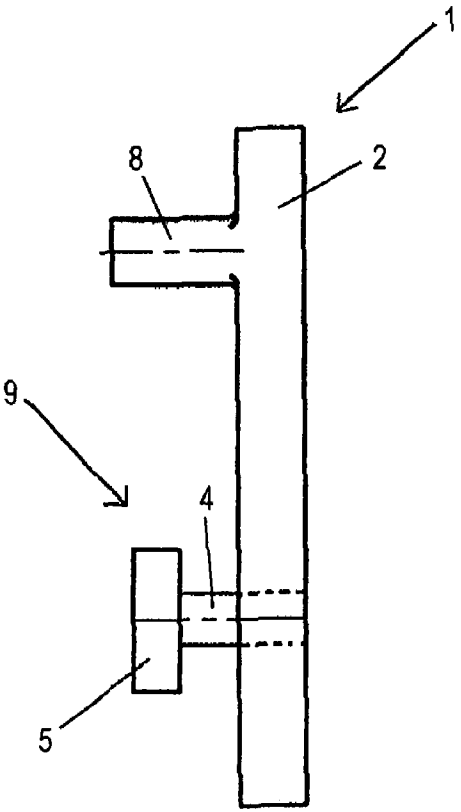
Figure 2A:
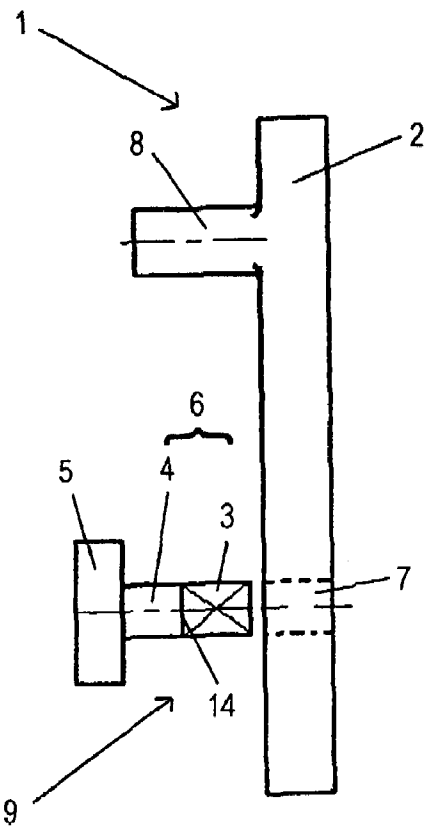

FIG. 2A shows a side view of the vane 1 according to the invention before being mounted to the insert 10. The vane 1 comprises a vane body 2 and tab member 9 which are separate parts. The vane body 2 has a pivot axle 8 about which the vane 1 can pivot when being mounted to the insert 10 as well as a mounting hole 7 into which the tab member 9 can be mounted.

The tab member 9 comprises a head 5 (tab portion) and a shaft 6 (shaft portion). The head 5 has an elongated shape (see FIG. 2D) which, with respect to the view of FIG. 2A, substantially extends in parallel to the vane body 2. With respect to the top view of the head 5, the elongated shape of the head 5 extends in a direction which can deviate from the direction in which the vane body 2 extends. As seen in FIG. 2A, the shaft 6 extends perpendicular to the head 5 and has a spacing section 4 and a tip section 3, wherein the spacing section 4 is provided close to the head 5 and the tip section is provided at the distal end of the shaft 6.

The cross-sectional area of the spacing section 4 is larger than that of the tip section 3 such that a stop face 14 is formed at the transition between these sections. In the present embodiment, the spacing section 4 has a circular cross-sectional shape while the tip section 3 has a D-shaped cross section (see FIG. 2G).

Also the mounting hole 7 provided in the vane body 2 has a D-shaped cross section which is slightly smaller than the D-shaped cross-section of the tip section 3 of the shaft 6 such that the tip section 3 can be press-fitted into the mounting hole 7. As a result of these cross-sectional shapes, the tab member 9 can be mounted to the vane body 2 in a very easy manner. Furthermore, the D-shaped cross sections of the tip section 3 and of the mounting hole 7 provide a relative rotation preventing means which sets the orientation of the elongated head 5 with respect to the vane body 2.

Furthermore, the spacing section 4 of the shaft 6 defines a predetermined length between the stop face 14 and the head 5. Thus, when the tab member 9 is mounted to the valve body 2 by press-fitting the tip section 3 into the mounting hole 7 until the stop face 14 abuts against the valve body 2, a predetermined distance between the head 5 and the vane body 2 is obtained. The significance of this distance is described later.

As can be seen in FIG. 2C, the vane body 2 has an elongated triangular shape. The more narrow end of the triangular shape is provided at the side of the pivot axle 8 while the broader end is provided at the side of the tab member 9.

Figure 3D:
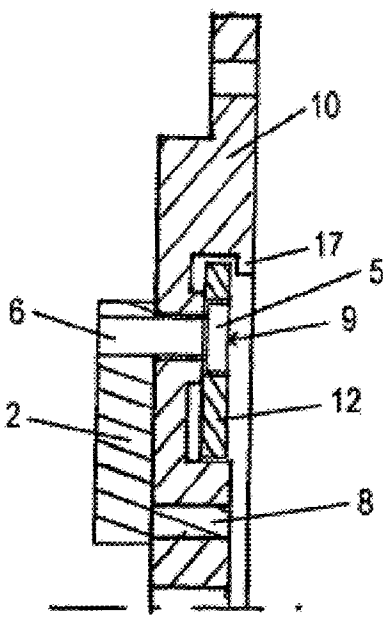
FIGS. 3A to 3D are cross-sectional views of a portion of an insert member to which the vane and a unison ring are being mounted, illustrating different stages of the mounting process.
Figure 3C:
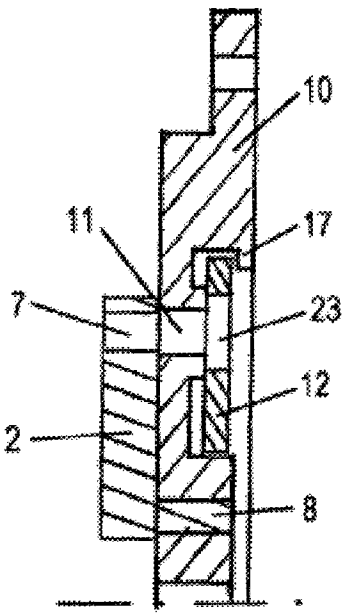
Figure 3B:
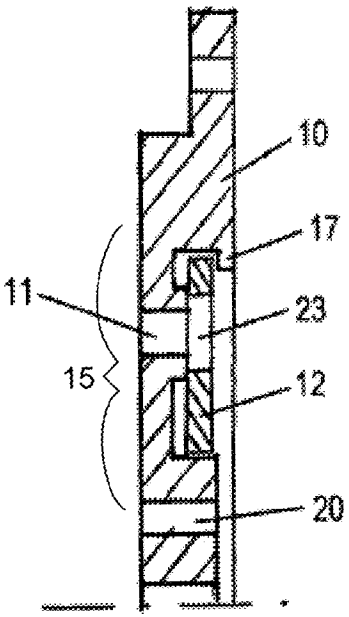
Figure 3A:
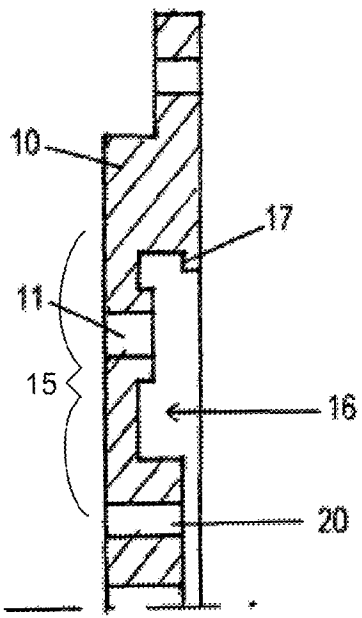

FIG. 3A shows a cross-sectional view of a portion of the insert 10. The insert 10 has a circular shape (see FIG. 4) and is provided with an annular groove 16 (see FIG. 3) into which the unison ring 12 is to be mounted. The insert 10 has an annular projection 17 which protrudes from a boundary line defining the radial outer circumference of the annular groove 16 in the radial inward direction into the annular groove 16. The unison ring 12 is to be placed into the annular groove 16 such that it is held in the axial direction by the projection 17, as can be understood from the following description.

Figure 4:
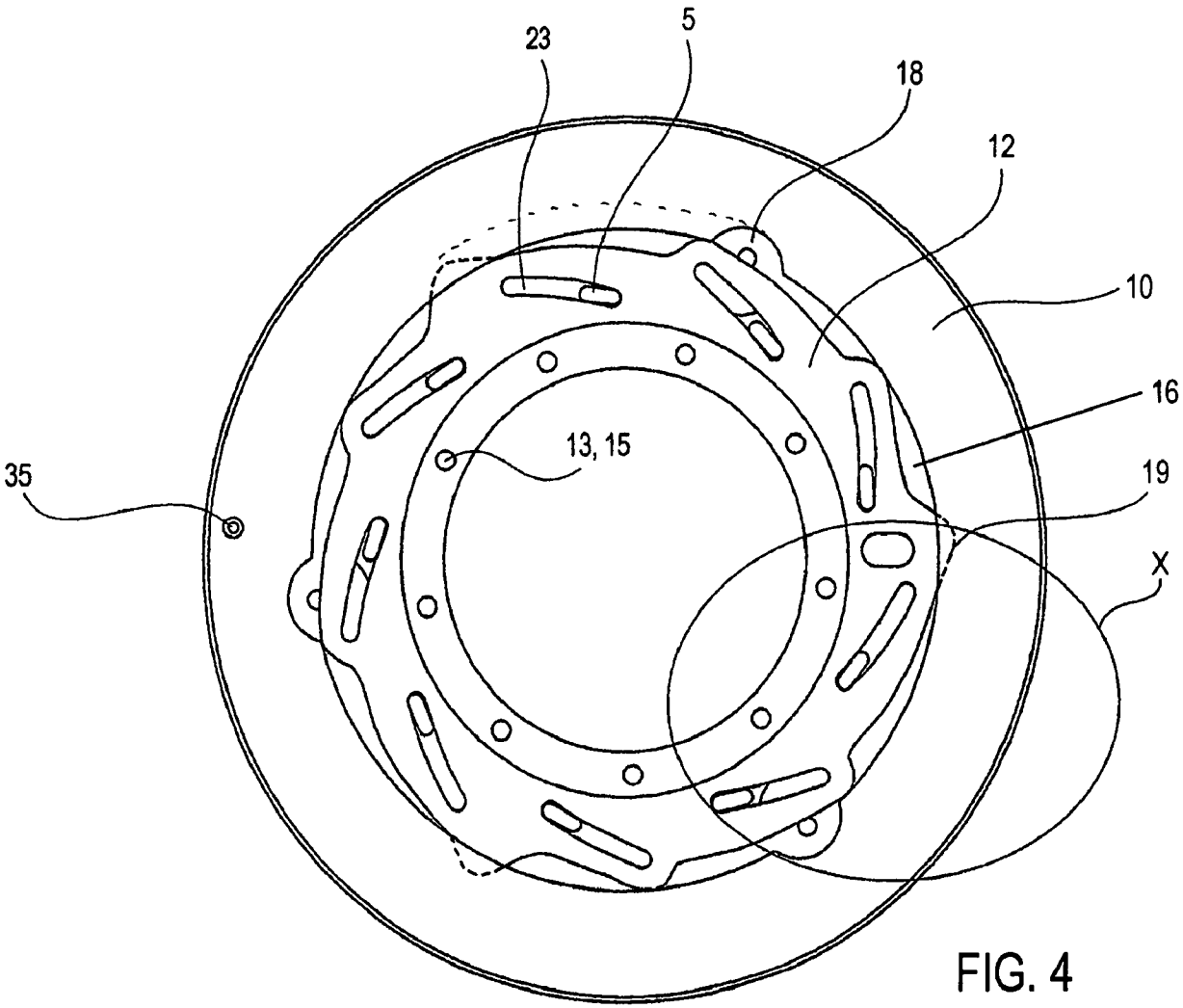
FIG. 4 is a front view of the variable nozzle device from a side on which the unison ring is provided.

When viewed from the back side, as is shown in FIG. 4, the circular insert 10 has three recesses 18 which are formed in the annular projection 17 and which are circumferentially arranged by equal intervals. Three protrusions 19 extend radial outwardly from the unison ring 12 and are also circumferentially arranged by equal intervals. The protrusions 19 fit into the recesses 1B. When mounting the unison ring 12 to the insert 10, the three protrusion 19 are aligned with the three recesses 18 of the insert 10 such that the unison ring 12 can be inserted into the groove 16 of the insert 10. Then, the unison ring 12 is rotated with respect to the insert 10, such that the protrusions 19 are moved behind the annular projection 17. As a result, the unison ring 12 is held in the axial direction by the projection 17 of the insert 10. This state is shown in FIG. 3B.

Figure 5:
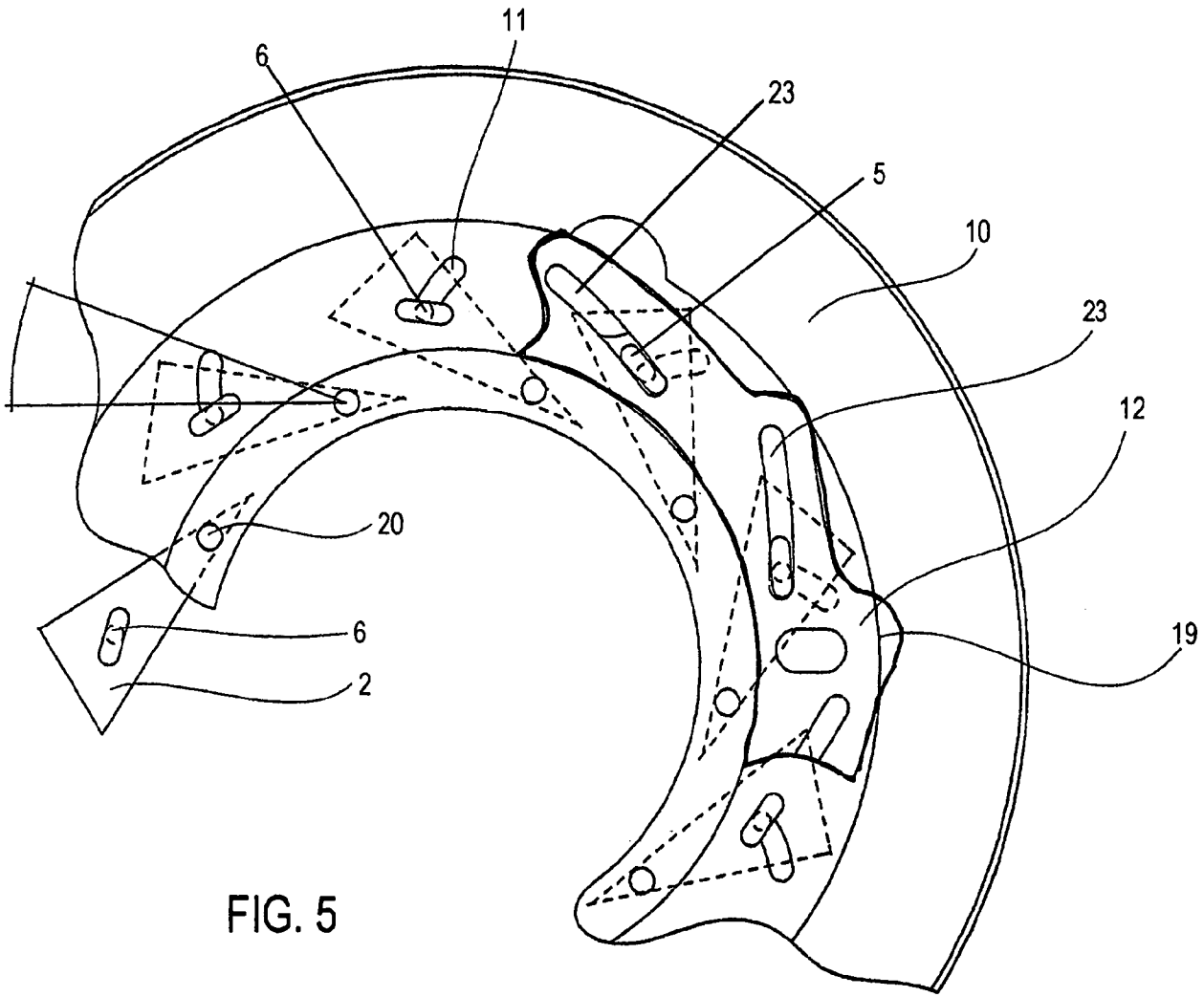
FIG. 5 is an enlarged cut-away view of the variable nozzle device from the side to which the unison ring is mounted, showing a closed position of the vanes.
Figure 6:
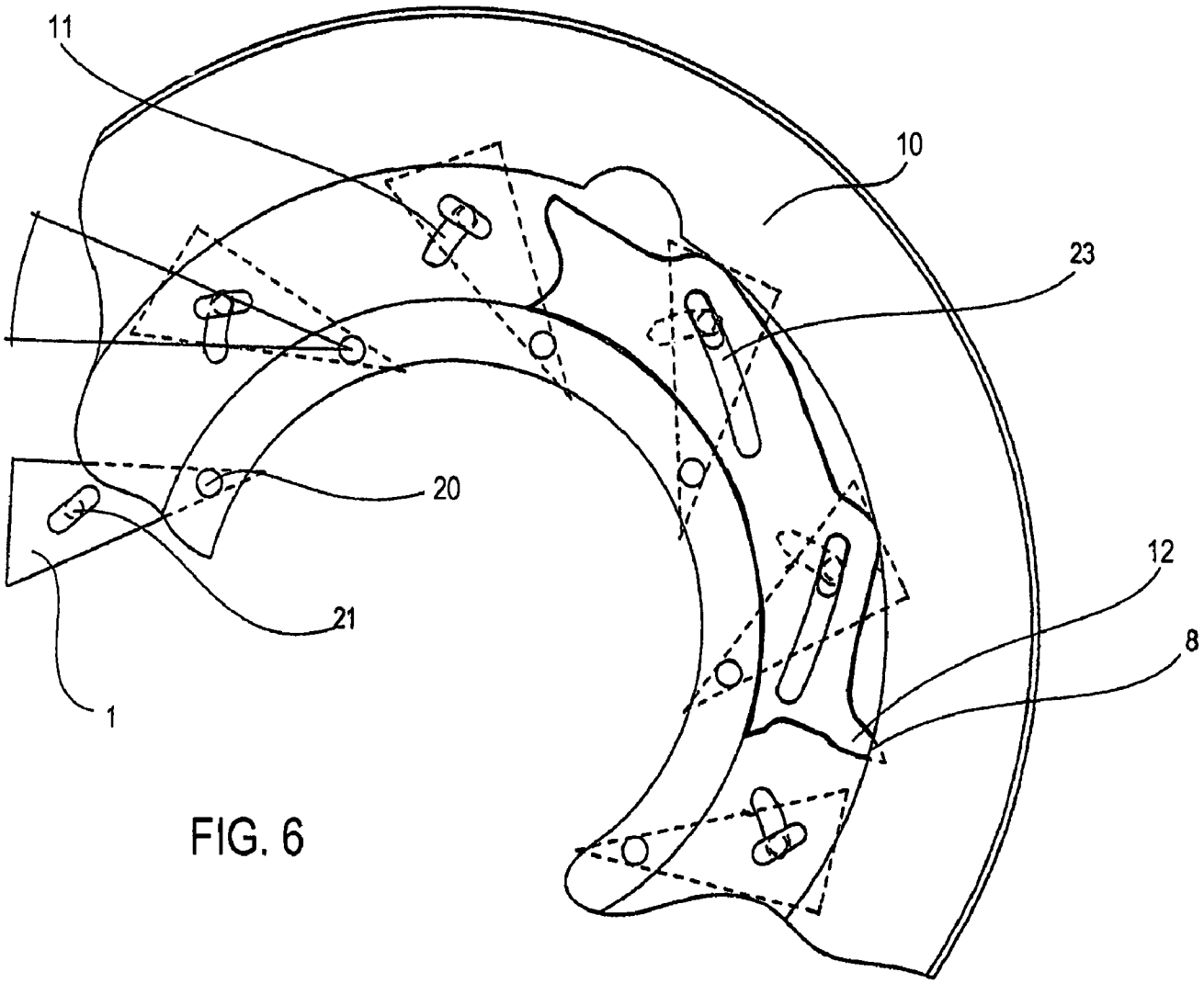
FIG. 6 is an enlarged cut-away view of the variable nozzle device from the side to which the unison ring is mounted, showing an opened position of the vanes.

FIGS. 5 and 6 show views of the variable nozzle device from the side to which the unison ring 12 is mounted. The unison ring 12 is only partly shown, i.e. the thick-lined portion represents a view on a part of the unison ring 12 while the thin lined portion is a view on the insert 10. The insert 10 has a guide slot 11, which is a curvilinear slot, for guiding the shaft 6 of the tab member 9 of the associated vane 1. The unison ring 12 has an actuating slot 23 for actuating the vane 1 via the head 5 of the tab member 9. Furthermore, the insert 10 has a pivot hole 20 which is open to the side of the insert 10 to which the vane 1 is to be mounted. A set of guide slot 11, actuating slot 23 and pivot hole 20 is provided for each of the vanes 1.

Back to FIG. 3C, the mounting of the vane 1 to the insert 10 having the unison ring 12 attached thereto is described. When the unison ring 12 is rotated so as to bring the protrusion 19 behind the projection 17 of the insert 10, as was described above, the unison ring 12 is rotated about such an extent that the actuating slots 23 of the unison ring 12 and the guide slots 11 of the insert 10 are aligned to each other.

Then, with reference to FIG. 3D, the vane 1 is mounted to the assembly of the insert 10 and the unison ring 12 by inserting the pivot axle 8 into the pivot hole 20 and bringing the mounting hole 7 of the vane body 2 into alignment with the guide slot 11 of the insert 10. As a next step, the tab member 9 is inserted from the unison ring side through the actuating slot 23 of the unison ring 12 and the guide slot 11 of the insert 10 into the mounting hole 7 of the vane body 2. The tab member 9 is press-fitted into the vane body 2 by pressing it towards the vane body 2 until the stop face 14 abuts against the insert side surface of the vane body 2.

In this state, the head 5 of the tab member 9 is accommodated in the actuating slot 23 as can be seen in FIG. 3D. Furthermore, due to the elongated shape of the actuating slot 23, the elongated shape of the head 5 and the D-shaped cross sectional shapes of the tip section 3 and of the mounting hole 7, respectively, the orientation of the vane body 2 with respect to the position of the unison ring 12 is set in an appropriate manner.

As can be seen in FIGS. 3A to 3D, the insert 10 has a slotted portion 15 through which the guide slot 11 extends. The length of the spacing section 4 is set as long as the thickness of the slotted portion 15, i.e. as long as the depth of the guide slot 11. Thus, the head 5 and the insert side surface of the vane body 2 slidingly grip the slotted portion 15 between each other. As a result, the vane body 2 is restricted in its movement away from the insert 10 in the axial direction thereof by the head 5 being in close contact with the unison ring side surface of the insert 10. In other words, the head 5 creates a stop which controls the vane end float with respect to the insert 10.

Furthermore, since the guide slot 11 is a curvilinear slot and not a T-shaped slot, the head 5 cannot pass through the guide slot 11 at any position of the guide slot. Thus, the entire guide slot 11 can be used for guiding the shaft 6 of the vane 1 without running the risk of the vane 1 falling from the insert 10 due to the tab portion 5 passing through an assembly slot.

An operation mode of the variable nozzle device is described based on FIGS. 5 and 6. With the vanes 1 being mounted to the insert 10, the head 5 of the tab member 9 is guided in the actuating slots 23 of the unison ring 12 while the shaft 6 is guided in the guide slots 11 of the insert 11. Herein, FIG. 5 shows the state in which the vanes 1 are in the closed position. In this state, the head 5 is located at the radial inner end of the actuating slot 23 and the shaft 6 is located at the radial inner end of the guide slot 11.

Now, when the unison ring 12 is rotated with respect to the insert 10 in the clockwise direction as seen in FIG. 4, the actuating slot 23 exerts a force to the head 5 of the tab member 9 which urges the tab member 9 toward the radial outward side of the insert 10 while the shaft 6 of the tab-member 9 is allowed to slide within the guide slot 11. Accordingly, the vane 1 is moved to its opened position with the shaft 6 sliding in the guide slot 11. In the fully opened state of the vane 1, the head S is located at the radial outer end of the actuating slot 23 while the shaft 6 is located at the radial outer end of the guide slot 11.

Thus, a variable nozzle device comprising the insert 10, the unison ring 12 as well as a plurality of vanes 1 is provided in the form of a preassembled cartridge.

A cartridge as described above can be used with a compressor of a turbocharger. Basically, a turbocharger is a device that uses exhaust gases produced by the engine to supply additional air into cylinders of the combustion engine. The turbocharger is mounted directly on the exhaust manifold, where exhaust gases pass over a turbine impeller that is attached to a shaft.

On the other side of this shaft, a compressor wheel is provided and is driven by the turbine via the shaft. The compressor wheel is located in a housing and draws suction air through an air filter, compresses this suction air and supplies it into an intake manifold of the engine via a volute in the housing. Thus, the energy from the exhaust gases, which would be wasted on a non-charged engine, is being used to supply additional air into the combustion engine leading to an increased engine power.

Figure 7:
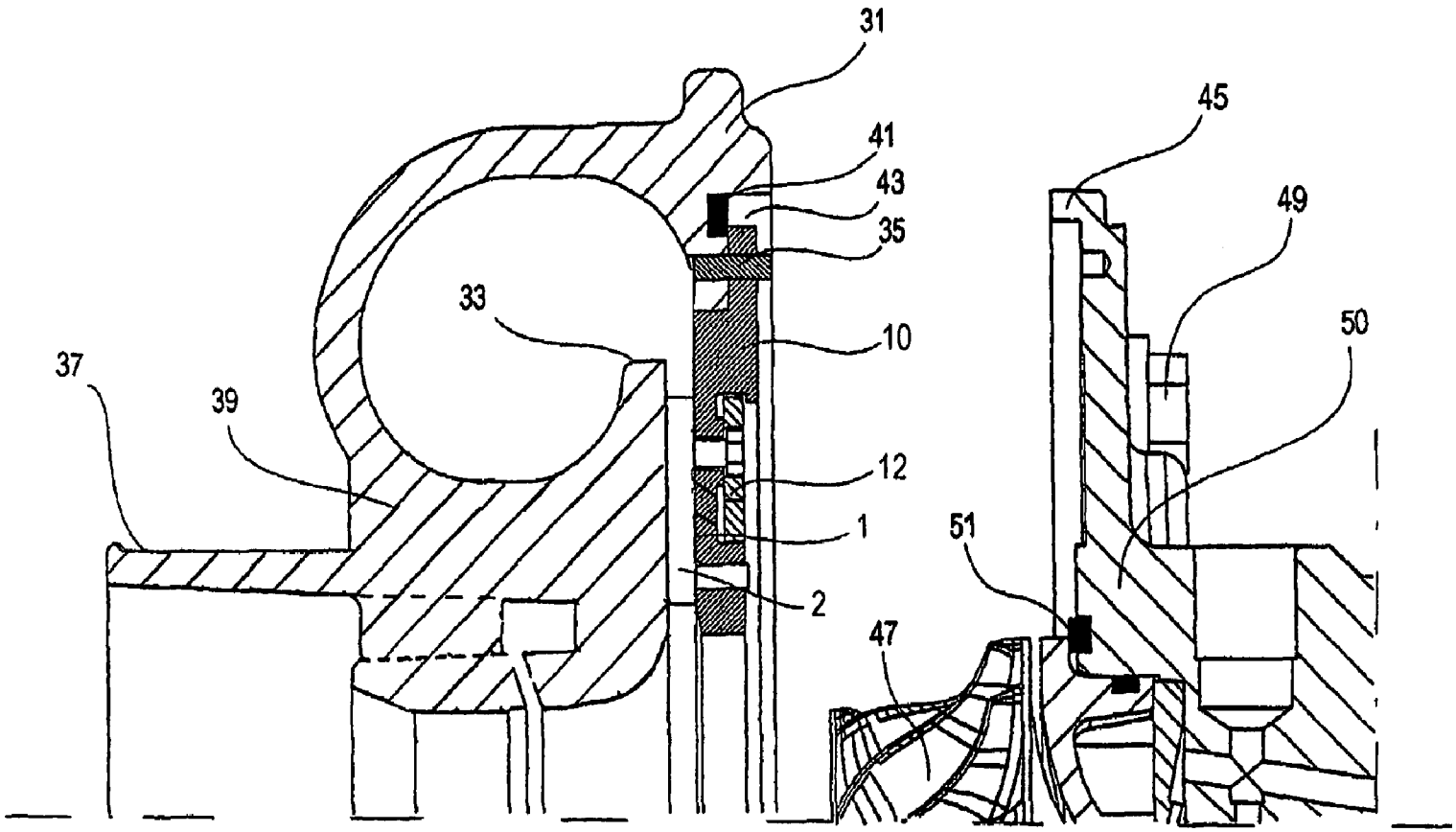
FIG. 7 is a cross-sectional view of the compressor housing and the center housing, with the variable nozzle device being mounted to the compressor housing before the same is mounted to the center housing.

FIG. 7 is a sectional view of a compressor nozzle device, in which the cartridge comprising the insert 10, the vanes 1 and the unison ring 12, is attached to a volute 31 of a compressor.

On the right side of FIG. 7, a center housing and rotating assembly 50 can be seen. The center housing and rotating assembly 50 connects a turbine side of a turbocharger with a compressor side via a shaft supported in the center housing. A compressor wheel 47 is attached to the shaft at its compressor side end.

Since the cartridge is manufactured as a sub assembly, the vanes 1 of the cartridge are already fully calibrated and after the cartridge has been attached to the volute, both can be aerodynamically tested, e.g. by using a certain testing device, before being attached to the housing 50.

The insert 10 of the cartridge is fixedly mounted to the volute 31 at a radial outer portion of the insert 10. In this way, the insert 10 projects into a circular groove 43 provided in a radial outer portion of the volute 31. At the bottom of this circular groove 43, a seal 41 is provided, which is kept in position by means of the insert 10.

The angular position of the cartridge relative to the volute 31 is maintained by an angular orientation pin 35 which is passed through respective bores in the volute 31, the insert 10 and the housing 50 of the center housing and rotating assembly.

The cartridge, the volute 31 and the inlet 37, shown on the left side of FIG. 7, form the compressor side of a turbocharger and are attached to the center housing 50 by known means, such as bolts 49.

As can be seen in FIG. 7, the cartridge does not comprise a diffuser plate and the vanes body 2 is directly, adjacent to a wall portion of the compressor housing which is also referred to as diffuser face. The vanes 1 do not need to touch the diffuser face, because they are held by the head 5 of the tab member 9. A gap can be present between the vanes 1 and the diffuser face.

Since no diffuser plate is present, no gaps or steps between the diffuser plate and compressor housing can occur, which gaps or steps would adversely affect the aerodynamic performance of the compressor. Furthermore, since the cartridge does not comprise a diffuser plate, no spacers between the diffuser plate and the insert are necessary for securing the distance between the diffuser plate and the insert, which spacer would adversely affect the aerodynamic performance of the compressor. The spacers and the diffuser plate are not necessary because the vane body 2 is held by the head S of the tab members in the axial direction of the insert 10 such that a vane end float is prevented. Accordingly, a support surface on which the vane body 2 can be supported in the axial direction of the insert and which conventionally was provided by the diffuser plate is not necessary. As a result, the vane 1 according to the invention makes it possible to manufacture a compressor having an improved aerodynamic performance.

Furthermore, since the tab member 9 of the vane 1 is mounted from the unison ring side surface of the insert 10 and not from the vane side of the insert 10, the head 5 of the tab member 9 does not need to be threaded through an assembly hole of the insert. Accordingly, such an assembly hale can be omitted. Since the conventional assembly hole has adversely affected the aerodynamic performance of the compressor, the vane 1 according to the invention makes it possible to manufacture a compressor having an improved aerodynamic performance.

Preferably, this cartridge concept having the variable nozzle device according to the invention is used for compressor housings a deformation of which does not largely affect a gap between the vanes and the diffuser face.

In the foregoing, a preferred embodiment of the invention has been described with reference to the Figures. However, it will be apparent to a person skilled in the art that further modifications can be carried out without departing from the scope of the claims.

For example, the spacing section 4 of the tab member can be set to be slightly shorter than the depth of the guide slot 11. As a result, with the tab member 9 press-fitted into the mounting hole 7 of the vane body, the head 5 rubs on the unison ring side surface of the insert 10. Accordingly, the vane end float can more securely be restricted.

Furthermore, the tab member does not need to be fixed to the vane body by press-fitting. These parts can also be fixed to each other by any other fixing methods. For example, they can be fixed by mutually brazing them to each other.

For example, the number of vanes and, thus, the number of assembly slots, pivot holes, actuating slots in the unison ring etc. are not restricted but can be adapted to the individual requirements.

Furthermore, the shape of the vanes can advantageously be adapted. For example, instead of the triangle shape, the vanes may e.g. have a curved shape, or the longer edges of the vanes may be substantially parallel to each other.

Although the nozzle device was described as a compressor nozzle device, it will be obvious to a person skilled in the art to use an equivalent nozzle device for a turbine, e.g. on a turbine side of a turbocharger.

Furthermore, the nozzle device is not restricted to be used with a turbocharger, but is suitable for any apparatus where fluids pass a flow path having a variable sectional area.

The invention claimed is:

1. A variable nozzle device comprising a wall member (10), a unison ring (12), and a plurality of vanes (1), wherein each vane (1) has a vane body (2) and a tab member (9) that slidingly engages the unison ring (12), the tab member (9) comprising a tab portion (5) and a shaft portion (6), said shaft portion (6) passing through a slot (11) of the wall member (10), and said tab portion (5) overlapping the slot (11) to hold the vane (1), characterized in that the vane body (2) and the tab member (9) are provided as separate parts and are fixable to each other wherein the tab portion (5) and the vane body (2) slidingly grip the wall member (10) there between.

2. The variable nozzle device according to claim 1, wherein a mounting hole (7) is provided in the vane body (2) at a side of the vane body (2) which faces the wall member (10), and a tip section (3) of the shaft portion (6) is insertable into the mounting hole (7) of the vane body (2).

3. The variable nozzle device according to claim 2, wherein the tab member (9) is fixable to the vane body (2) by press-fitting the tip section (3) of the shaft portion (6) into the mounting hole (7).

4. The variable nozzle device according to claim 2 or 3, wherein the tip section (3) and the mounting hole (7) have corresponding cross-sectional shapes which fit to each other and which provide a relative rotation preventing means for preventing a rotation of the tab member (9) relative to the vane body (2).

5. The variable nozzle device according to claim 2, wherein the shaft portion (6) comprises a spacing section (4) disposed between the tip section (3) and the tab portion (5), said spacing section (4) defining a predetermined distance between the tip section (3) and the tab portion (5).

6. The variable nozzle device according to claim 5, wherein the cross-sectional area of the spacing section (4) is larger than the cross-sectional area of the tip section (3) to form a stop face (14) which restricts the insertion depth of the tab member (9).

7. The variable nozzle device according to claim 5, wherein the wall member (10) comprises a slotted portion (15) having the slot (11) through which the shaft portion (6) of the tab member (9) is passed, and wherein the length of the spacing section (4) is set based on a thickness of the slotted portion (15) such that the tab portion (5) and the vane body (2) slidingly grip the wall member (10) there between.

8. The variable nozzle device according to claim 1, wherein wherein the slot (11) is shaped in such a manner that the vane (1) is held by the tab portion (5) disregarding the position of the vane (1) with respect to the wall member (10).

9. The variable nozzle device according to claim 1, wherein the slot (11) is curvilinear.

10. A method of assembling a variable nozzle device comprising a wall member (10), a unison ring (12), and a plurality of vanes (1), wherein each vane (1) has a vane body (2) and a tab member (9) that slidingly engages the unison ring (12), the tab member (9) comprising a tab portion (5) and a shaft portion (6), the method comprising the steps of arranging the vane body (2) on one side of the wall member (10), passing the shaft portion (6) of the tab member (9) through the slot (11) from another side of the wall member (10), and fixing the shaft portion (6) to the vane body (2) wherein the tab portion (5) of the tab member (9) and the vane body (2) slidingly grip the wall member (10) there between.

11. The method according to claim 10, wherein the shaft portion (6) is fixed to the vane body (2) by inserting a tip section (3) of the shaft portion (6) into a mounting hole (7) of the vane body (2).

12. The method according to claim 10, wherein, before passing the shaft portion (6) of the tab member (9) through the slot (11), a mounting hole (7) of the vane body (2) is aligned with the slot (11) of the wall member (10); and fixing of the shaft portion (6) to the vane body (2) is made by press-fitting a tip section (3) into the mounting hole (7).

13. The method according to claim 10, wherein before performing the step of inserting the shaft portion (6) of the tab member (9) through the slot (11) of the wall member (10) into a mounting hole (7), performing the steps of arranging the unison ring (12) having an actuating slot (13) on said second side of the wall member (10), aligning the actuating slot (13) with the slot (11) of the wall member (10), and then inserting the shaft portion (6) through said actuating slot (13) of the unison ring (12) to place the tab portion (5) in said actuating slot (13).

14. The method according to claim 10, further comprising the step of pressing a tip portion (3) of the tab member (9) into a mounting hole (7) of the vane body (2) until the stop face (14) of the tab member (9) abuts against the vane body (2).

15. A variable nozzle device comprising a wall member (10), a unison ring (12), and a plurality of vanes (1), wherein each vane (1) has a vane body (2) and a tab member (9) comprising a tab portion (5) and a shaft portion (6), said shaft portion (6) passing through a slot (11) of the wall member (10), and said tab portion (5) overlapping the slot (11) to hold the vane (1), characterized in that the vane body (2) and the tab member (9) are provided as separate parts and are fixable to each other wherein the tab portion (5) and the vane body (2) slidingly grip the wall member (10) there between;

wherein a mounting hole (7) is provided in the vane body (2) at a side of the vane body (2) which faces the wall member (10), and a tip section (3) of the shaft portion (6) is insertable into the mounting hole (7) of the vane body (2).

16. A method of assembling a variable nozzle device comprising a wall member (10), a unison ring (12), and a plurality of vanes (1), wherein each vane (1) has a vane body (2) and a tab member (9) comprising a tab portion (5) and a shaft portion (6), the method comprising the steps of arranging the vane body (2) on one side of the wall member (10), passing the shaft portion (6) of the tab member (9) through the slot (11) from another side of the wall member (10), and fixing the shaft portion (6) to the vane body (2) wherein the tab portion (5) of the tab member (9) and the vane body (2) slidingly grip the wall member (10) there between;

wherein the shaft portion (6) is fixed to the vane body (2) by inserting a tip section (3) of the shaft portion (6) into a mounting hole (7) of the vane body (2).

* * * * *